US010029762B2

(12) United States Patent
Padick

(10) Patent No.: US 10,029,762 B2
(45) Date of Patent: Jul. 24, 2018

(54) TETHER AND CLAMP ASSEMBLY

(71) Applicant: Phillip Padick, Carmel Valley, CA (US)

(72) Inventor: Phillip Padick, Carmel Valley, CA (US)

( * ) Notice: Subject to any disclaimer, the term of this patent is extended or adjusted under 35 U.S.C. 154(b) by 0 days.

(21) Appl. No.: 14/251,866

(22) Filed: Apr. 14, 2014

(65) Prior Publication Data

US 2014/0305362 A1 Oct. 16, 2014

Related U.S. Application Data

(60) Provisional application No. 61/811,197, filed on Apr. 12, 2013.

(51) Int. Cl.
*B63B 21/00* (2006.01)

(52) U.S. Cl.
CPC ..... *B63B 21/00* (2013.01); *B63B 2021/003* (2013.01)

(58) Field of Classification Search
CPC ..... B63B 21/00; B63B 2021/003
USPC ..... 114/230.23; 119/795
See application file for complete search history.

(56) References Cited

U.S. PATENT DOCUMENTS 3,093,859 A * 6/1963 Cooper ..... A22C 25/025 269/54
3,645,468 A 2/1972 Edelberg et al.
4,312,089 A * 1/1982 Taylor ..... 441/32
4,738,222 A * 4/1988 Terry et al. ..... 119/781
5,148,581 A * 9/1992 Hartmann ..... A44B 99/00 16/4
5,490,805 A 2/1996 Bredesen
D369,217 S * 4/1996 Mitchell et al. ..... D24/193
D380,864 S * 7/1997 Deakin et al. ..... D28/40
6,009,824 A * 1/2000 Ross ..... 114/218
6,618,910 B1 * 9/2003 Pontaoe ..... F16G 11/14 24/115 H
6,684,462 B1 * 2/2004 Narula ..... A44B 11/02 24/115 R (Continued)

FOREIGN PATENT DOCUMENTS

GB 2448696 A * 10/2008

OTHER PUBLICATIONS

Kayak Fishing Blog, Jun. 24, 2008 "New Products At Hook 1" , "http://kayakfishingblog.com/2008/06/new-products-at-hook-1/".*

*Primary Examiner* — Anthony D Wiest
(74) *Attorney, Agent, or Firm* — Global Intellectual Property Agency, LLC; Jordan Sworen

(57) ABSTRACT

An anchoring device is provided that is adapted to tether a structure to a fixed support, such as a dock or floating kelp. The anchoring device comprises a reel assembly that enables a user to secure their boat without the use of an anchor. The assembly includes a reel housing, a retractable line, a clamp assembly, and a line guide. The reel housing comprises a pair of control buttons, a gripping handle, and an attachment strap. The first button is adapted to unlock and lock the retractable line in place, whereas the second button is adapted to retract the line back into the housing. The clamp assembly is adapted to secure the anchoring device onto a fixed or floating surface, whereby the clamp assembly comprises a first and second clamp member in biased relationship with one or more of peripheral teeth, inner tines, and a high friction inner surface.

14 Claims, 5 Drawing Sheets

(56) References Cited

U.S. PATENT DOCUMENTS

Figure 1:
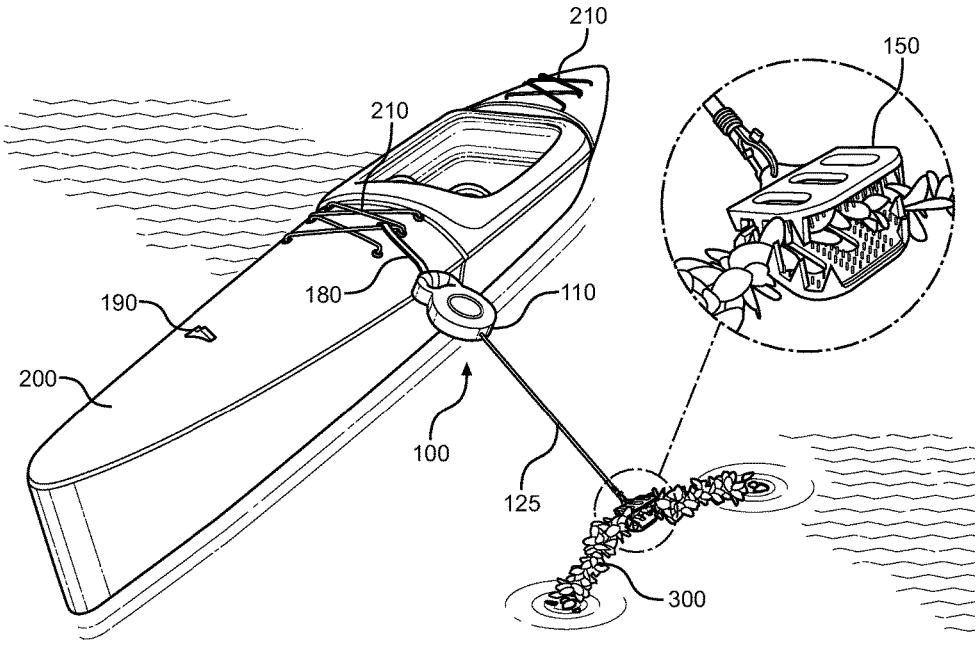

| | | | | |
|---|---|---|---|---|
| 6,904,872 | B2 * | 6/2005 | Muller | 119/796 |
| 7,013,535 | B2 * | 3/2006 | Tracy | A44B 99/00 24/115 H |
| 7,484,273 | B1 * | 2/2009 | Dupree et al. | 24/3.13 |
| 7,882,793 | B1 | 2/2011 | Paulus | |
| 2004/0149306 | A1 * | 8/2004 | Rogers | 132/277 |
| 2009/0071298 | A1 * | 3/2009 | Lombardi et al. | 81/152 |

* cited by examiner

TETHER AND CLAMP ASSEMBLY

CROSS REFERENCE TO RELATED APPLICATION

This application claims the benefit of U.S. Provisional Application No. 61/811,197 filed on Apr. 12, 2013. The above identified patent application is herein incorporated by reference in its entirety to provide continuity of disclosure.

BACKGROUND OF THE INVENTION

Field of the Invention

The present invention relates to a boat tether. More specifically the invention relates to a handheld reel housing with a retractable line and a clamping mechanism that is adapted for providing an attachment between a small boat and a support, such as kelp.

A tether is a device that is adapted to join a first object to a second object, whereby the second object may be stationary or moving. For boats, traditionally a tether is used to secure the boat by providing an anchor that rests on the sea floor, or by securing a rope around a dock.

In use, the tethers must comprise a means for securing onto both the boat and the object, however, problems arise when a user is traveling with a small boat, such as a kayak. It is not advantageous for a user to support an anchor on the surface of a kayak, and doing so might overload the kayak. Also, if not stationed by a dock, a traditional rope may not comprise a means for attaching or securing on objects or plant-life of the intended resting area of the individual. Thus, there is a need for a tether assembly that is adapted to secure onto objects that may be found in nature when kayaking.

There are several prior art devices that provide a tether between a small boat and a secondary object. These tethers typically comprise ropes with an anchor attached at the end thereof. Alternatively, the tethers are adapted to secure around a boat dock. These prior art devices, however, fail to provide a distal attachment that is adapted to secure onto a fixed object, such as floating kelp.

The present invention provides a tether that is adapted to be used between a small boat, such as a kayak or a similar floating structure, and a secondary object, such as floating kelp. The device comprises a reel assembly that includes a reel housing having a pair of control buttons, a gripping handle, and a retractable line that is adapted to wind around a rotating cylinder. In use, an individual may depress the first button in order unlock the housing and pull out a desired length of line. Thereafter, a user may secure a clamp onto the distal end of the line. The user can then secure the clamp onto kelp or other nearby object, thereby preventing the kayak from drifting away. After use, the user may disconnect the clamp from the kelp and retract the extended line into the housing by depressing the second button, which rotates the cylinder, thereby bringing the line into the reel housing.

Description of the Prior Art

Devices have been disclosed in the prior art that relate to devices that are utilized for securing a boat in a body of water. These include devices that have been patented and published in patent application publications. These devices generally relate to tethers that comprise anchors on an end thereof. The following is a list of devices deemed most relevant to the present disclosure, which are herein described for the purposes of highlighting and differentiating the unique aspects of the present invention, and further highlighting the drawbacks existing in the prior art.

One such prior art device, U.S. Pat. No. 5,490,805 to Bredesen provides a retractable tether that is adapted for removably securing a surfboard to the leg of a surfer. The tethering device comprises a storage unit that contains a length of rope, and a strap at distal end of the rope. In use, the storage unit is secured onto the surfboard and the rope is extended outward therefrom, thereby enabling an individual to secure the strap around him or herself. Thereafter, the rope extends and retracts from the storage unit housing in order to maintain constant tension between the surfer and the surfboard. The retractable tethering device, however, fails to provide the patentable features of the present invention. The prior art fails to provide a retractable tether that is adapted for securing a kayak onto a floating object, such as kelp. Further, the prior art fails to provide a retractable tether that terminates in a distal clamping mechanism with rows of securing teeth thereon.

Another prior art device, U.S. Pat. No. 3,645,468 to Edelberg provides an anchor reel line assembly. The assembly is mountable onto the underside of a boat deck and comprises a line therein that terminates in a distal anchor that is adapted for maintaining a boat in a fixed location in a body of water. In use, an individual can extend out the retractable line and drop the anchor into the water. The individual may pull on the line to uproot the anchor from the seafloor. Thereafter the retractable line wraps around the reel assembly as the anchor is raised out of the water. The prior art reel line assembly, however, fails to provide an anchoring system that comprises a clamp that is adapted for securing onto floating kelp.

Finally, U.S. Pat. No. 7,882,793 to Paulus provides a lightweight anchor that is designed for use with small watercraft. The anchor comprises a bag with a plurality of metal flukes thereon. The bag includes an opening thereon that has an interior compartment that is adapted for receiving sand or other similar weighted object therein. When filled, the anchor is tossed over the small vessel and into the water. Thereafter the anchor sinks to the water and the flukes anchor themselves into the seafloor, thereby maintaining the small watercraft within a fixed area of the water. The prior art anchor, however, fails to provide a retractable mechanism that terminates in a distal clamp that is adapted for securing onto a secondary object, such as floating kelp, a branch, or a boat dock.

The present invention, however, provides a reel assembly that is adapted to act as a tether between a small boat and a fixed surface, such as floating kelp. The reel assembly comprises a reel housing that includes a pair of first and second reel control buttons, a gripping handle, and a rotating cylinder that is adapted to support a length of line thereon. The first reel control button is biased to lock the length of line in place on the reel, whereas the second button is adapted to retract the extended rope within the housing interior. The distal end of the rope comprises a clip thereon that is adapted to secure onto a clamp. The clamp comprises upper and lower jaws that include outer and inner securing mechanisms. The outer securing mechanisms comprise elongated and offset pointed teeth, whereas the inner securing mechanisms include a plurality of tines. The teeth of the outer row are adapted to clamp and secure onto objects such as boat docks or plant life, such as strands of kelp. The inner securing mechanisms, however, are adapted to secure onto smaller objects, such as the leaves of kelp. The combination of the inner and outer rows provide a securing mechanism that is adapted to securely and removably attach onto a variety of objects in order to maintain a small boat in a desired area.

In view of the drawbacks of the prior art devices, it is shown that the prior art has several known setbacks and that the present invention is substantially divergent in design elements from the prior art and subsequently it is clear that there is a need in the art for an improvement to existing boat anchoring devices. In this regard the instant invention substantially fulfills these needs.

SUMMARY OF THE INVENTION

In view of the foregoing disadvantages inherent in the known types of boat tethers now present in the prior art, the present invention provides a new boat tether wherein the same can be utilized for providing convenience for the user when attempting to secure a boat to a fixed support, such as kelp.

It is therefore an object of the present invention to provide a new and improved boat tethering device that has all of the advantages of the prior art and none of the disadvantages.

It is another object of the present invention to provide a tether system comprising a retractable cable that is adapted to extend to a support mechanism.

Another object of the present invention is to provide a tether system having a distal clamp that comprises a plurality of teeth thereon.

Another object of the present invention is to provide a tether system having a distal clamp that comprises a first and second clamp member in a biased relationship and a reel assembly for extending and automatically retracting the clamp.

Another object of the present invention is to provide a tether system having a distal clamp that alternatively comprises no teeth and one that comprises a rubberized interior clamping surface.

Yet another object of the present invention is to provide a tether system that is adapted to secure onto loose plant life, such as kelp, as well as rigid structures such docks and other man-made supports.

Another object of the present invention is to provide a tether system that can secure a boat or similar floating structure to nearly any nearby structure or support.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a view of the reel assembly of the present invention, whereby the line of the assembly secures a boat to a fixed support.

Figure 2:
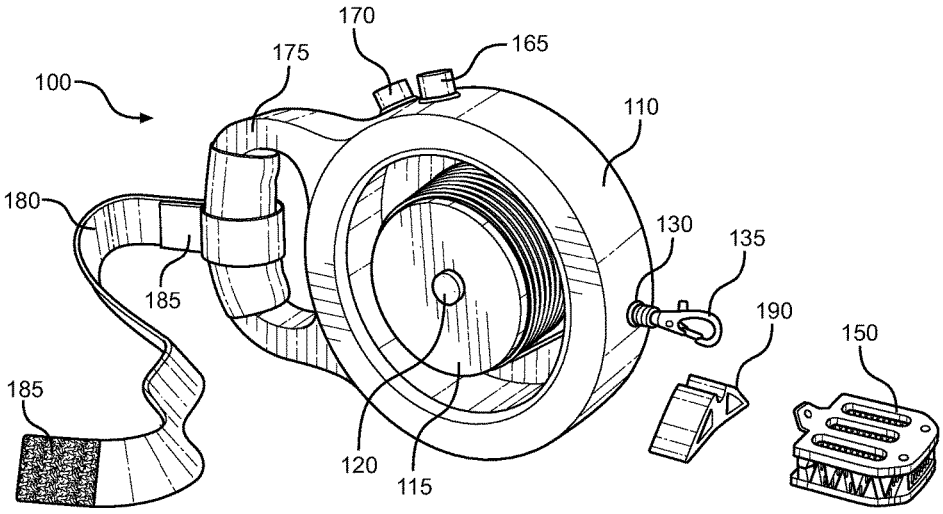

FIG. 2 displays a view of the components of the reel housing.

Figure 3:
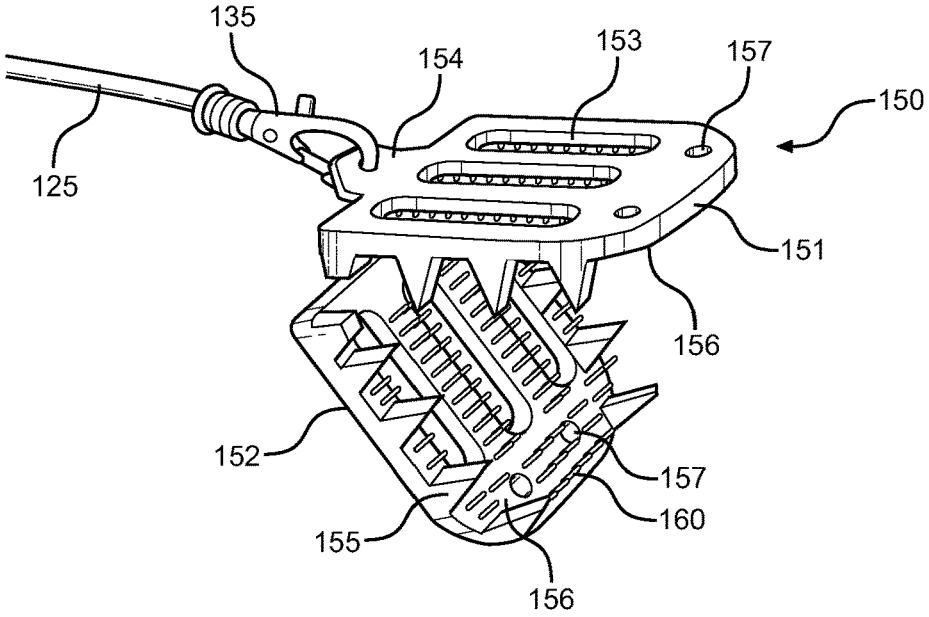

FIG. 3 displays a close-up view of the clamp of the present invention in an open state.

Figure 4:
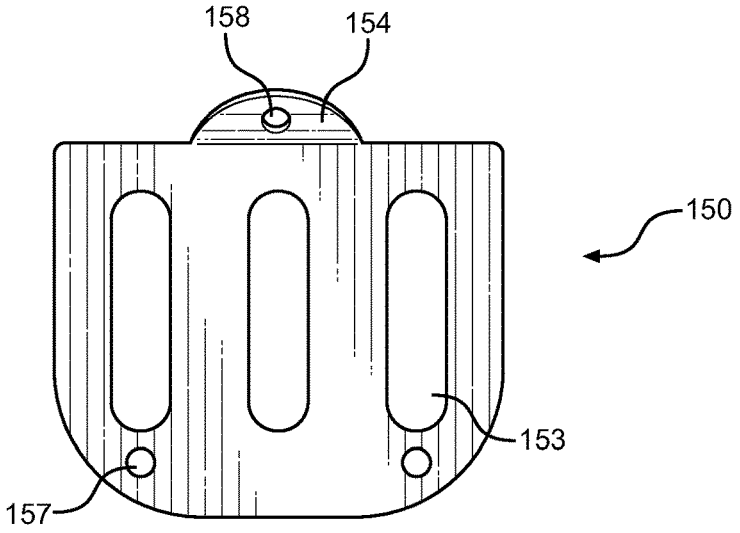

FIG. 4 displays an overhead view of the clamp of the present invention.

Figure 5:
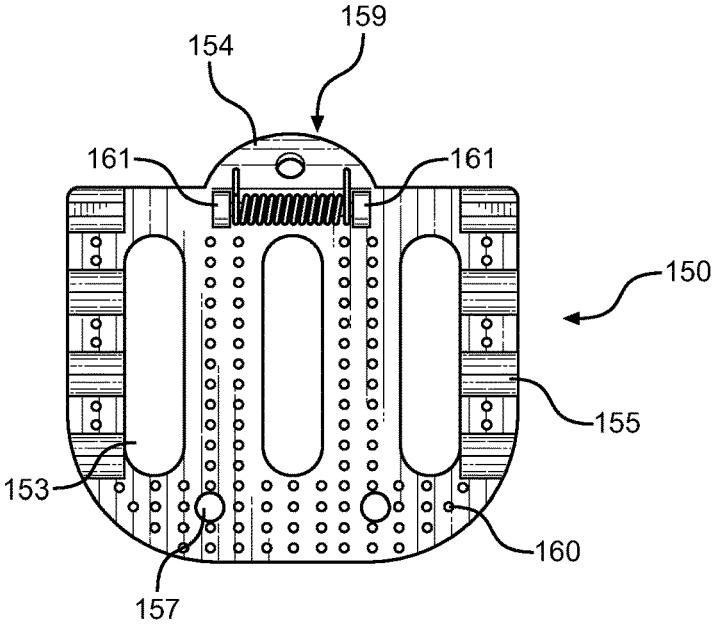

FIG. 5 displays a view of the lower half of the clamp of the present invention.

Figure 6:
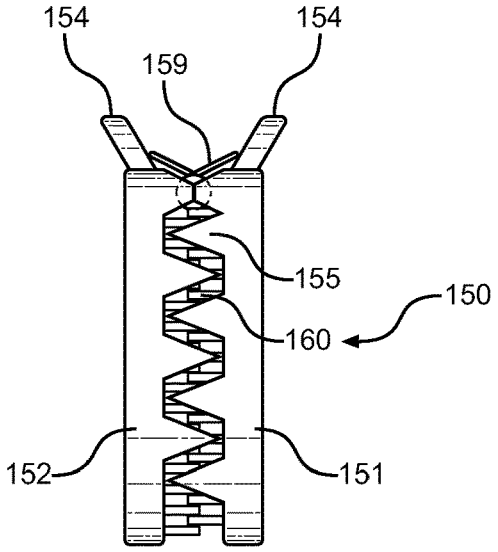

FIG. 6 displays a side view of the clamp of the present invention.

Figure 7:
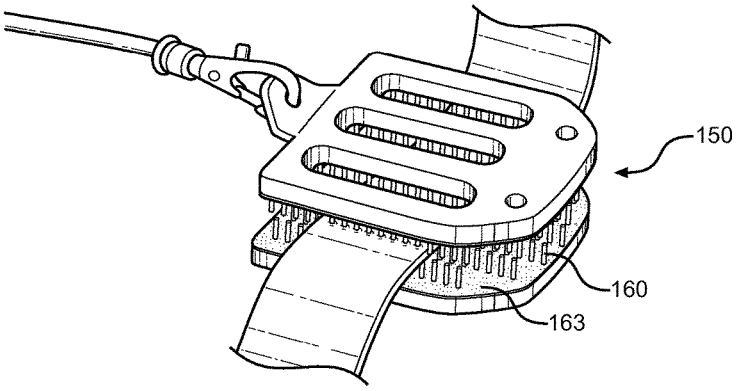

FIG. 7 displays a view of an alternate embodiment of the clamp of the present invention.

Figure 8:
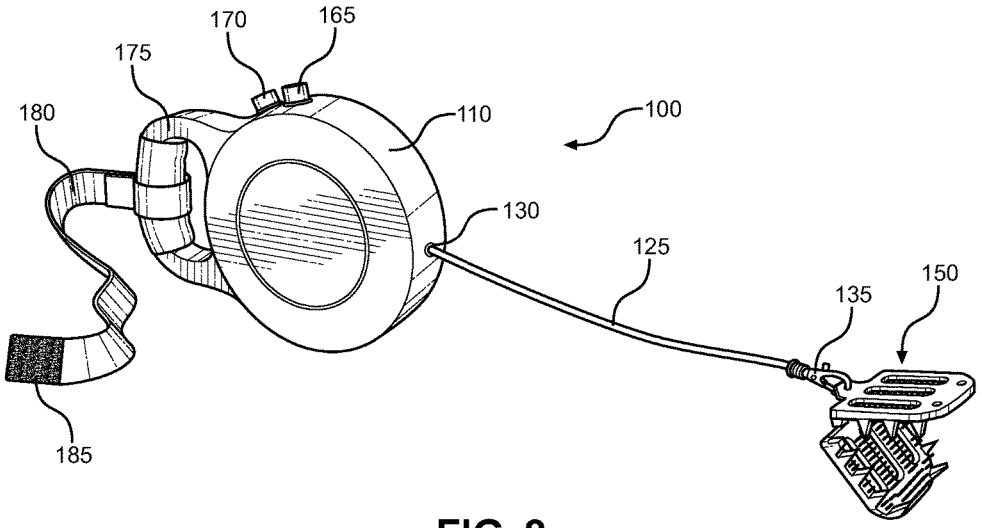

FIG. 8 displays a view of the reel assembly with a partially retracted tethering line.

Figure 9:
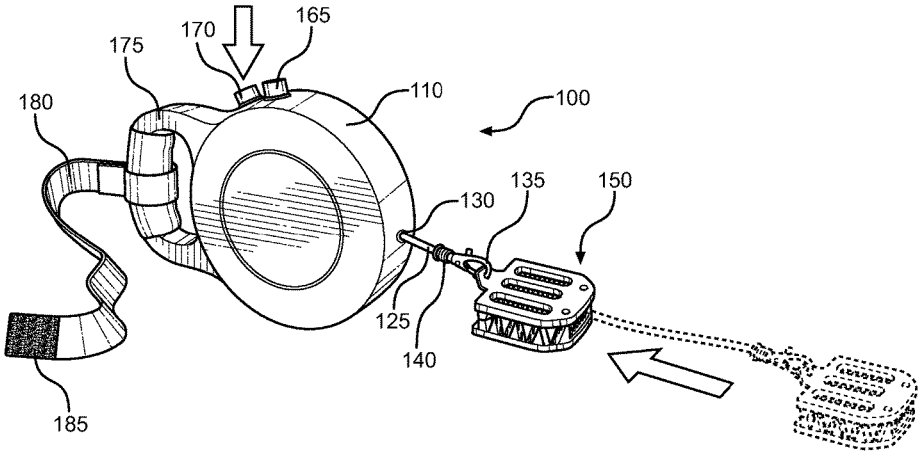

FIG. 9 displays a view of the reel assembly with a retracted tethering line.

Figure 10:
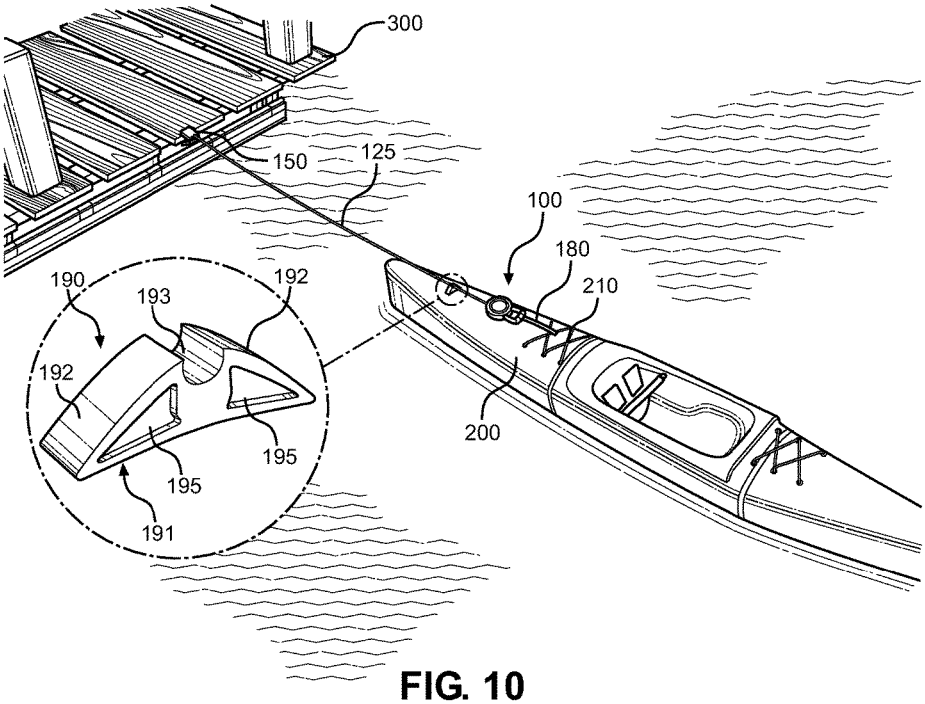

FIG. 10 displays a view of the tethering line threaded positioned through a guide and the clamp secured to a boat dock.

DETAILED DESCRIPTION OF THE INVENTION

Reference is made herein to the attached drawings. Like reference numerals are used throughout the drawings to depict like or similar elements of the reel assembly. For the purposes of presenting a brief and clear description of the present invention, the preferred embodiment will be discussed as used for tethering a small boat to a fixed support. The figures are intended for representative purposes only and should not be considered to be limiting in any respect.

Referring now to FIG. 1, there is displayed a view of the reel assembly 100 of the present invention, whereby a line of the reel housing secures a small boat 200 to a fixed support 300. The assembly 100 comprises a reel housing 110, a retractable line 125, an attachment strap 180, a clamp 150, and a line guide 190. The reel assembly 100 is adapted to tether a line 125 between a small boat 200, such as a kayak, and a fixed support 300, such as a dock, seaweed, or floating kelp. The assembly is advantageous for those who may wish to remain secured to an area for an amount of time, such as fisherman, sightseers, and those wishing to relax after paddling. A user may travel to a desired location with their small boat, extend out the line of the reel housing, and clamp the distal end of the line onto a fixed support, thereby maintaining the small boat in proximity of the fixed support.

Referring now to FIG. 2, there is displayed a view of the components of the reel housing. The housing 110 comprises an internal compartment therein that includes a rotatable cylindrical reel 115 that is adapted to support a wound length of line thereon. A proximal end of the line is secured to the cylindrical reel, a mid-portion of the line is repeatedly wound around the reel, and the distal end of the line extendable through an aperture 130 of the housing.

The exterior surface of the reel housing comprises a pair of reel control buttons, a gripping handle 175, and an attachment strap 180. The pair of reel control buttons include a first button 165 adapted to unlock and lock the line in place, whereas the second button 170 is adapted to retract the line. The first button 165 is biased to lock the line in place within the reel housing 110. Depression of the button 165 releases a locking means from the distal end of the line, thereby allowing a user to extend out the line to a desired length. When the desired amount of line is extended out of the reel housing 100, the user may then release the first button 165 to reengage the locking means, thereby maintaining the length of extended line.

The distal end of the line comprises a swivel clip 135 that may be removably attached to a fixed support securing mechanism, such as a clamp 150. The clamp 150 may be opened and removably secured to onto a floating or fixed support, such as a boat dock, seaweed or even floating kelp. Thereafter, a user may depress the first button 165 to release an internal locking mechanism. A central pin 120 within the housing 110 supports the cylindrical reel 115. Disengagement of the locking mechanism 165 by depression of the button enables a user to pull out a length of line through the aperture 130 of the housing 110. Removal of the line 125 from the housing 110 facilitates the rotation of the cylindrical reel 115 about the central pin 120, thereby enabling the smooth removal of the length of line while increasing the distance between the fixed support and the small boat. The locking mechanism and spring biased return mechanism of the reel are considered well understood in the art of reels and tethers. The present invention contemplates the use of a lockable, biased reel that supports an elongated tether. The working end of the tether is adapted to support a clamp that can be attached to fixed or floating structures in the water.

As illustrated in FIG. 1, when the desired distance between the boat 200 and the fixed support 300 is reached, the reel housing 110 can be secured onto the receiving area 210 on the boat 200. The exterior surface of the reel housing 110 comprises a gripping handle 175. On the gripping handle 175, there may be an attachment strap 180 that is adapted to provide a link between a boat 200 and the reel housing 110. The proximal and distal ends of the strap can have fasteners 185, such as buttons, snaps, hook and loop fasteners, or other suitable fastener that is capable of being removably secured onto the handle 175 and a small boat 200.

Referring now to FIGS. 3 through 6, there are shown several views of the clamp assembly 150 of the present invention. The clamp 150 comprises a first 151 and second 152 clamp member in a biased relationship. A clamp members 151, 152 are hinged together at a hinge joint 161 and biased closed via a coil spring 159. Along the proximal end of each member is a tab 154 and aperture 158 for securing the swivel clip 135 and tether line 125 of the present invention thereto. This allows the clamp 150 to be interchangeable with the reel assembly and thus allows the user to choose a specific clamp for a give ask.

Each of the clamp members includes an inner surface 156 that is adapted to be a clamping surface against a support. Disposed on the clamping surface are preferably a set of outer securing means and a set of inner securing means. The outer securing means comprises enlarged and substantially triangular teeth 155 disposed along the outer periphery of each member 151,152. These teeth 155 are pointed, elongated, and are adapted for closing down and securing onto a fixed support. The teeth 155 are staggered between the first 151 and second 152 member to prevent interferences. The offset teeth 155 are adapted to clamp onto close around strands of kelp and other structure when in the water, thereby holding the kelp therebetween. Alternatively, with larger structures such as a boat dock, the teeth 155 can clamp down onto a portion of the dock, thereby tethering the boat to a man-made and more stable structure.

The second clamp securing means of the clamp assembly 150 comprises a plurality of elongated and upstanding tines 160. The tines 160 are upstanding rods or protuberances that are disposed along the inner surface 156 of each clamp member and are located interiorly in relation to the peripheral teeth 155. The tines 160 are adapted to grip onto small or thinner fixed supports. For example, whereas the outer teeth 155 may clamp down on a strand of kelp, the inner tines 160 may secure onto the leaves of the kelp, thereby facilitating enhanced securement of fixed structure within the clamp.

Each of the clamping members 151, 152 further provides a plurality of apertures therethrough. A first set of elongated apertures 153 is provided along the body of each clamp member. These elongated apertures 153 allow water to pass therethrough and facilitate the clamp assembly 150 connection to loose aquatic plant life without interference. Further provided are apertures 157 along the distal ends of each member. These can be used to secure alternate clips or attachments to a single clamp assembly.

Referring now to FIG. 7, there is shown a view of an alternative configuration of the clamping assembly 150. It is contemplated that the clamping assembly 150 may comprise the outer peripheral teeth, the interior tines 160, and a high friction surface 163 in one assembly. It is further contemplated, as shown in FIG. 7, that the clamping assembly comprises only tines 160 and a high friction inner surface 163. The high friction surface comprises a rubber or similar material along the inner surface of each clamp member. It is finally contemplated that the clamp may deploy only a high friction inner surface 163 without the tines 160 or peripheral teeth.

Referring now to FIGS. 8 and 9, there is illustrated view of the reel assembly 100 with a partially extended tether line and a view of the line being retracted into the reel housing. While actuation of the first button 165 enables a user to release the locking means, actuation of the second button 170 is adapted to retract the line 125 back into the reel housing 110. The reel housing comprises a retraction means having a spring mechanism that is actuated by the depression of the second button 170, wherein the retraction means is connected to both the button 170 and the cylindrical reel 115 (See FIG. 2). Repeated depressions of the second button 170 facilitate the turning of the cylindrical reel 115, thereby actuating the lengthwise retraction of the line 125 into the reel housing 110. Alternatively, a sustained depression of the second button 170 can facilitate a continuous retraction of the line 125. The swivel clip 135 comprises a lip 140 that is sized to overlap the aperture 130 of the reel housing 110, thereby providing a blocking means that prevents the entirety of the line 125 from retracting within the reel housing 110.

Referring finally to FIG. 10, there is illustrated a view of the extendable line 125 threaded through a line guide 190. The line guide 190 comprises a body having a base 191, a pair of upwardly angled side walls 192, an upper surface comprising a depression or divot 193 between the side walls 192, and an optional pair of throughways 195. The base 191 may comprise a fastener that is adapted to secure the base onto a surface of the boat, including adhesive, hook and loop fastener, or even a mechanical fastener therethrough. The base 191 may comprise a flat and planar surface, or alternatively may comprise a curvature adapted to conform to the surface of a boat 200. In use, the user positions the line 125 through one of the depression 193 of the guide 190 such that the line 125 at that position is statically supported in place. The clamp assembly 150 remains secured to a fixed support, such as floating kelp or a dock, while the line guide 190 positions a portion of the line between the reel 100 and the clamp assembly 150 along the boat 200. Alternatively, the line 125 may be positioned through one of the throughways 195, or a pair of reel housings 100 may each thread a line through the throughways of the guide. A pair of lines would assist the boat in maintaining a desired direction in relation to the fixed support, and the separated clamps at the distal ends of the line would greatly reduce the swaying of the boat while in the water.

The present invention provides a reel assembly 100 that is adapted to tether a small boat, such as a kayak, to a fixed support, such as floating kelp. The reel assembly comprises a reel housing, a retractable line, an attachment strap, a clamp, and a line guide. The reel housing is adapted to support the retractable line therein. The housing comprises an exterior surface that includes a hand grip that is adapted to support the attachment strap, and a pair of reel control buttons. The first button is biased to lock the retractable line in place. Depression of the first button displaces the locking mechanism, which enables a user to manually pull out a length of line. To lock the line in place, a user can release the first button when a sufficient amount of line is drawn out of the housing.

The second button is adapted facilitate the retraction of the length of line. Depression of the button actuates a spring mechanism of the retraction means within the reel housing. Each depression of the button brings in a measured amount of line, or alternatively, a continued depression of the second button brings in a constant amount of line. In a primary embodiment, depression of the second button also releases the locking mechanism that is actuated by the first button, thereby enabling the line to freely retract into the housing. In an alternative embodiment, the second button must be depressed in combination with the first button to free up the locking mechanism, thereby enabling the reel cylinder to rotate and bring in a length of line.

The clamp of the assembly is adapted to secure onto a fixed surface, such as floating kelp. The clamp comprises a pair of outer and inner securing mechanisms. The outer mechanisms comprise side rows of elongated teeth, whereby the upper row is offset from the lower row, which enables the rows of teeth to close down on strands of kelp. The inner securing mechanisms comprise a plurality of tines that resemble miniature projections. These tines are adapted to secure onto small, thinner supporting means, such as the leaves of kelp. The combination of the outer and inner securing mechanisms facilitates the securing of the clamp on to a variety of fixed structures, such as plant-life and manmade structures.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reel assembly, comprising:

a reel housing having an interior compartment and an exterior surface;

said interior compartment comprising a rotatable reel and a length of line;

said line comprising a proximal end, a length, and a distal end;

whereby said proximal end is secured onto said reel, said length being adapted for wrapping around said reel, and said distal end extending from said interior compartment through an aperture;

said distal end of said line further comprising a clamp assembly;

said clamp assembly comprising a first clamp member and a second clamp member hinged to one another and biased together;

each of said first clamp member and said second clamp member further comprising an inner surface having a peripheral edge;

a plurality of substantially triangular teeth disposed on opposing lateral sides along said peripheral edge of each said first and second clamp member;

said triangular teeth of said first clamp member and said second clamp member being staggered relative to one another; and a plurality of upstanding tines along said inner surface of said first and second clamp member, wherein each tine of said plurality of upstanding tines comprises a cylindrical shape, wherein said plurality of upstanding tines are disposed in a plurality of rows along said inner surface of said first clamp member and said second clamp member, wherein a distal end of each tine of the plurality of upstanding tines comprises a flat surface.

2. The reel assembly of claim 1, wherein:

a high friction surface disposed along said inner surface of said first clamp member and said second clamp member.

3. The reel assembly of claim 1, wherein:

at least one aperture disposed through said inner surface of each of said first clamp member and said second clamp member.

4. The reel assembly of claim 1, whereby said reel housing comprises:

a first control button and a second control button;

said first control button being connected to a locking means for locking said reel line in a static state;

said second control button being connected to a spring biased retracting mechanism of said reel to retrieve said line into said housing interior compartment.

5. The reel assembly of claim 1, whereby said reel housing exterior surface comprises a gripping handle.

6. The reel assembly of claim 5, whereby said gripping handle further comprises an attachment strap thereon, whereby said strap is adapted for securing said reel assembly onto a small boat.

7. The reel assembly of claim 1, whereby said reel assembly further comprises a line guide, said line guide comprising a base, a pair of upwardly angled side walls, and an upper surface having a depression adapted to support said line therein.

8. The reel assembly of claim 7, wherein said base comprises a fastener that is adapted for securing said line guide onto a support.

9. The reel assembly of claim 7, wherein said upwardly angled side walls each comprise a throughway therethrough.

10. The reel assembly of claim 9, wherein said throughways and said depression are adapted for receiving said reel line, thereby maintaining said reel line therein.

11. The reel assembly of claim 1, wherein:

said distal end of said line further comprising a swivel clip;

said swivel clip being connected said clamp assembly.

12. The reel assembly of claim 1, wherein:

said clamp assembly comprises at least one tab having an aperture therethrough.

13. The reel assembly of claim 1, wherein each of said first clamp member and said second clamp member comprise a substantially rectangular shape.

14. The reel assembly of claim 13, wherein each corner of said first clamp member and said second clamp member comprises a curve.

* * * * *